US010104946B2

(12) United States Patent
Liu

(10) Patent No.: US 10,104,946 B2
(45) Date of Patent: Oct. 23, 2018

(54) SECURING DEVICE FOR RUNNER OF UMBRELLA

(71) Applicants: Fu-Tien Liu, New Taipei (TW); Fu Long (Fujian) Umbrella Co., Ltd., Jinjiang (CN)

(72) Inventor: Fu-Tien Liu, New Taipei (TW)

(73) Assignee: Fu Long (Fujian) Umbrella Co., Ltd., Jinjiang (CN)

( * ) Notice: Subject to any disclaimer, the term of this patent is extended or adjusted under 35 U.S.C. 154(b) by 0 days.

(21) Appl. No.: 15/889,713

(22) Filed: Feb. 6, 2018

(65) Prior Publication Data

US 2018/0235330 A1 Aug. 23, 2018

(30) Foreign Application Priority Data

Feb. 17, 2017 (CN) ..... 2017 2 0144600 U

(51) Int. Cl.
*A45B 25/08* (2006.01)

(52) U.S. Cl.
CPC ..... *A45B 25/08* (2013.01)

(58) Field of Classification Search
CPC ..... A45B 25/08; A45B 25/06; A45B 25/14
USPC ..... 135/28, 37–41, 25.4
See application file for complete search history.

(56) References Cited

U.S. PATENT DOCUMENTS 5,287,869 A * 2/1994 Wu ..... A45B 19/04 135/25.1
5,494,064 A * 2/1996 Chuang Lee ..... A45B 25/06 135/28
6,006,477 A * 12/1999 Ko ..... A45B 19/04 135/25.4
6,382,222 B1 * 5/2002 Ko ..... A45B 25/08 135/25.1
6,758,229 B2 * 7/2004 Wang ..... A45B 25/08 135/39
6,941,960 B2 * 9/2005 Huang ..... A45B 25/08 135/28
7,025,015 B2 * 4/2006 Wilcox ..... A01K 91/08 114/255
7,089,950 B2 * 8/2006 Lin ..... A45B 25/08 135/28
8,336,567 B2 * 12/2012 Su ..... A45B 25/06 135/28
8,356,612 B2 * 1/2013 Liu ..... A45B 25/00 135/25.4
8,459,281 B2 * 6/2013 Chen ..... A45B 25/08 135/28

(Continued)

*Primary Examiner* — Winnie Yip

(74) *Attorney, Agent, or Firm* — C. G. Mersereau; Nikolai & Mersereau, P.A.

(57) ABSTRACT

An umbrella includes a shaft including multiple inner tubes and an outer tube in which the multiple inner tubes are retractably received. One of the inner tubes that has a smallest diameter is connected to a cap on the top end of the shaft. A runner is movably mounted to the shaft and includes a release part. Multiple ribs are pivotably connected to the cap. Multiple stretchers are pivotably connected between the ribs and the runner. A gore is mounted to the ribs. A seat is mounted to the outer tube and includes a resilient protrusion protruding laterally therefrom. The resilient protrusion of the seat is engaged with the release part of the runner when the runner is moved to an umbrella-opening position to open the umbrella.

5 Claims, 5 Drawing Sheets

(56) References Cited

U.S. PATENT DOCUMENTS

2005/0194027 A1* 9/2005 Ko ..... A45B 25/08
135/39
2008/0289668 A1* 11/2008 Liu ..... A45B 25/08
135/20.3

* cited by examiner

SECURING DEVICE FOR RUNNER OF UMBRELLA

BACKGROUND OF THE INVENTION

1. Fields of the Invention

The present invention relates to a securing device for positioning the runner when the umbrella is opened.

2. Descriptions of Related Art

The conventional runner is movable along the shaft of an umbrella, and the runner is moved to a top position to open the umbrella. The runner needs a positioning part to position the runner to keep the umbrella in an opened status. Generally, there is a stop resiliently received in a slot defined through the wall of the shaft and the stop stops the runner at the position to open the umbrella. However, the slot weakens the strength of the rod which can be broken because of the weak structure of the shaft. For multi-section umbrella, the diameter of each section of the shaft is small, the slot further weakens the strength of the shaft.

A multi-section umbrella known to applicant includes an outer tube which is connected to the cap, and multiple smaller inner tubes are connected to the outer tube in sequence. The section that has the smallest diameter is located at the handle of the umbrella so avoid the shortcoming mentioned above. However, this makes the weight center of the umbrella locate at a high position which makes the umbrella different to control. The optimal design choice for the shaft is to connect the smaller section with the cap and the largest section connected with the handle. Besides, the inner diameter of the runner has to be greater than the outer diameter of the outer tube to allow the runner to move along the shaft, there will be a large gap formed between the runner and the smallest section of the shaft. Therefore, the runner shafts when opening the umbrella.

The present invention intends to provide a securing device which includes a resilient protrusion on the seat so as to reduce the gap between the shaft and the runner to make the umbrella to be opened stably.

SUMMARY OF THE INVENTION

The present invention relates to an umbrella and comprises a shaft including multiple inner tubes and an outer tube in which the multiple inner tubes are retractably received. One of the inner tubes that has the smallest diameter is connected to a cap which is located at the top end of the shaft. A runner is movably mounted to the shaft and has a release part. Multiple ribs are pivotably connected to the cap. Multiple stretchers are pivotably connected between the ribs and the runner. A gore is mounted to the ribs. A seat is mounted to the outer tube and includes a passage through which the outer tube extends. The seat has a resilient protrusion protruding laterally therefrom. The resilient protrusion is engaged with the release part when the runner is moved to an umbrella-opening position to open the umbrella.

Preferably, the release part is a pressing plate or a hole.

Preferably, the seat includes a notch. The outer tube includes a boss which is engaged with the notch when the outer tube is connected to the seat.

Preferably, the runner includes an extension section which has the release part formed thereto. The resilient protrusion is disengaged from the release part when pressing the release part.

Preferably, a sleeve is movably mounted to the extension section. The sleeve includes a recess defined in the inner periphery thereof and the release part is accommodated in the recess when opening the umbrella. The sleeve includes an inclined face formed at the inner top of the recess. When moving the runner away from the cap, the inclined face pushes the release part inward.

By the engagement between the resilient protrusion and the release part, the gap between the runner and the shaft is eliminated, so that the umbrella is opened stably. The present invention improves the shortcoming of unstable runner found gap between the inner periphery of the runner and the shaft of the conventional umbrellas when the umbrellas are opened.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
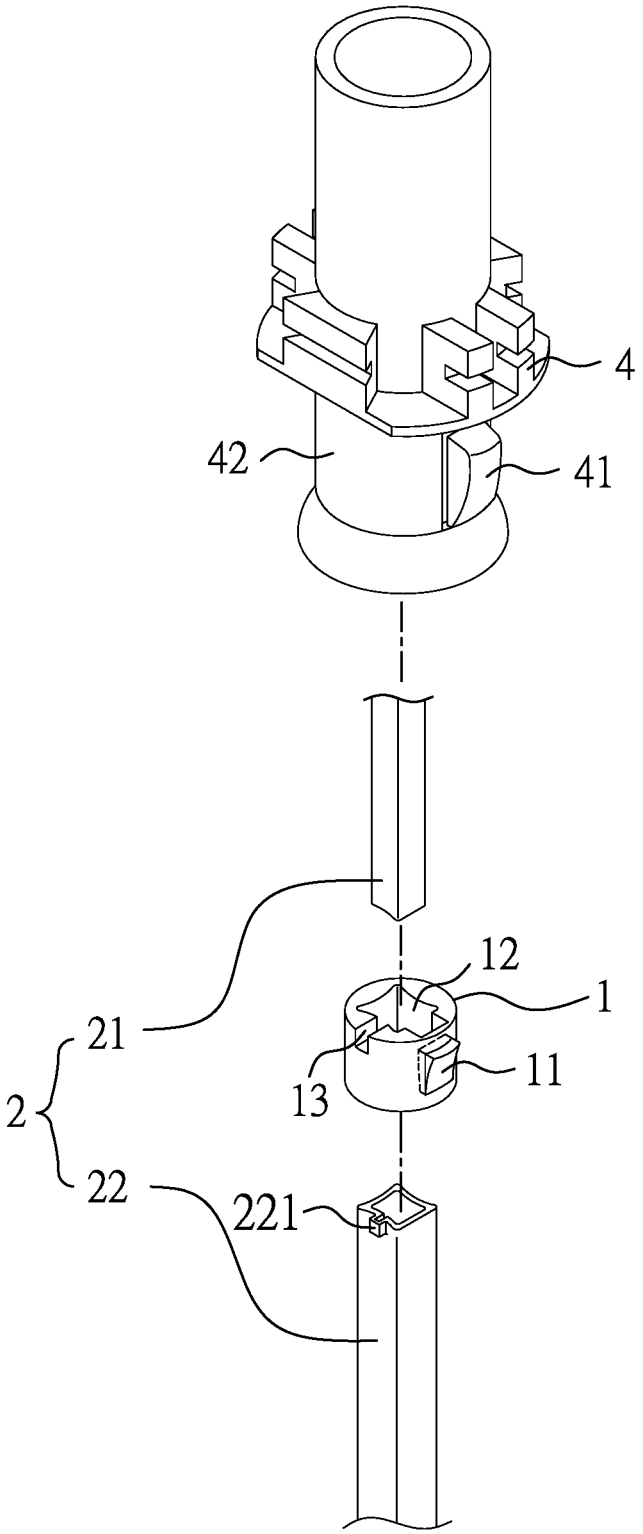
FIG. 1 is an exploded view to show the seat, the shaft, and the runner of the securing device of the umbrella of the present invention.
Figure 2:
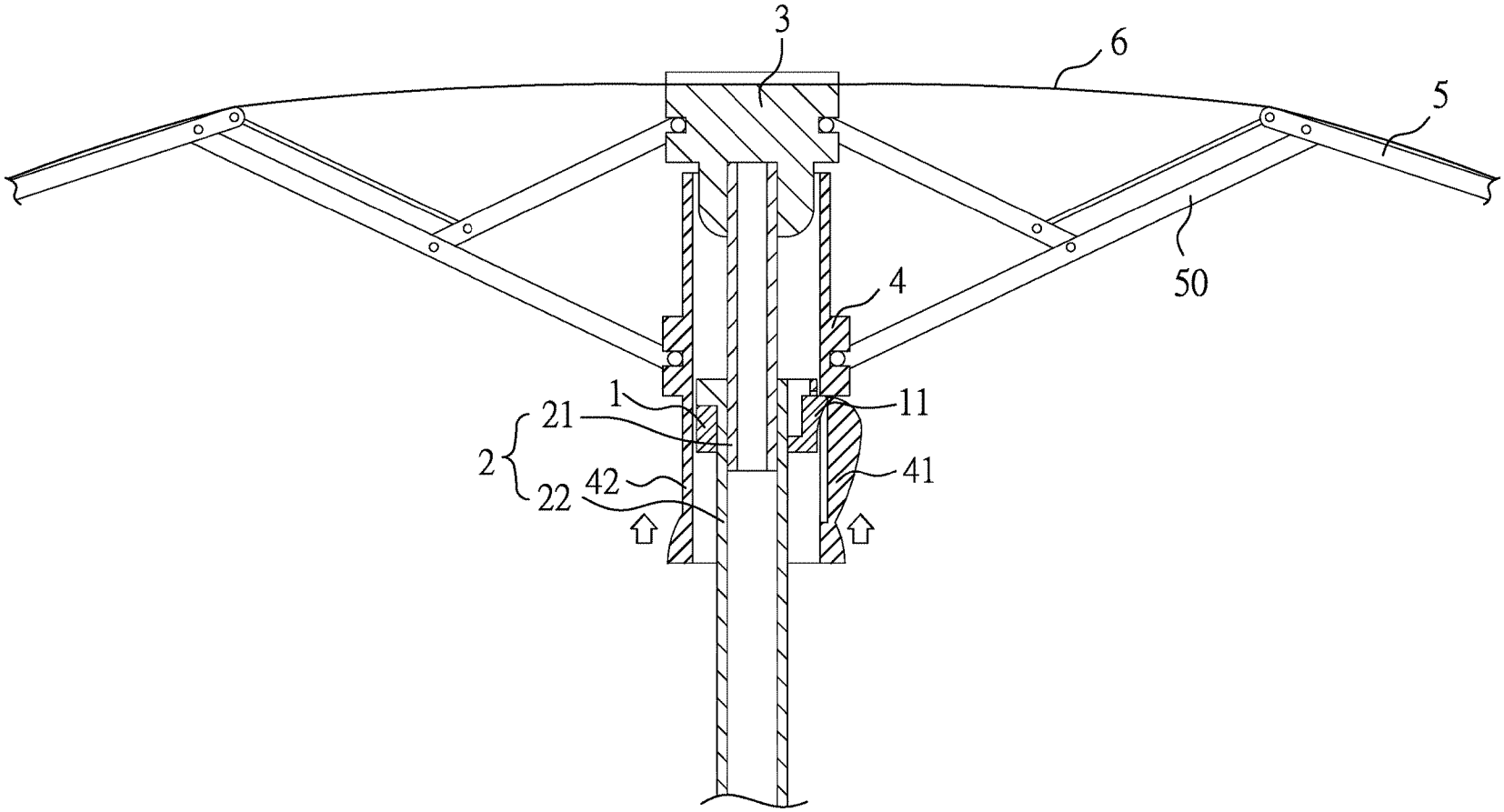
FIG. 2 is a cross sectional view to show the securing device of the present invention when the umbrella is opened.

Referring to FIGS. 1 and 2, the umbrella of the present invention comprises a shaft 2, a cap 3, a runner 4, multiple ribs 5, multiple stretchers 50 and a gore 6. The shaft 2 includes multiple inner tubes 21 and an outer tube 22 in which the multiple inner tubes 21 are retractably received. One of the inner tubes 21 that has the smallest diameter is connected to the cap 3 on the top end of the shaft 2. The outer tube 22 is located at the handle of the umbrella. The runner 4 is movably mounted to the shaft 2. The multiple ribs 5 are pivotably connected to the cap 3. The multiple stretchers 50 are pivotably connected between the ribs 5 and the runner 4, and the gore 6 is mounted to the ribs 5. A seat 1 is mounted to the outer tube 22 and includes a passage 12 through which the outer tube 22 extends. The seat 1 includes a resilient protrusion 11 which integrally protrudes laterally from the seat 1. The runner 4 includes a release part 41. The resilient protrusion 11 is engaged with the release part 41 when the runner 4 is moved to the umbrella-opening position to open the umbrella. In this embodiment, the release part 41 is a pressing plate or a hole, such that the resilient protrusion 11 is engaged with the release part 41. When the runner 4 is moved to the umbrella-opening position, the resilient protrusion 11 protruding from the seat 1 is engaged with the release part 41, such that the runner 4 is stably positioned while the umbrella is in the opened status.

Figure 3:
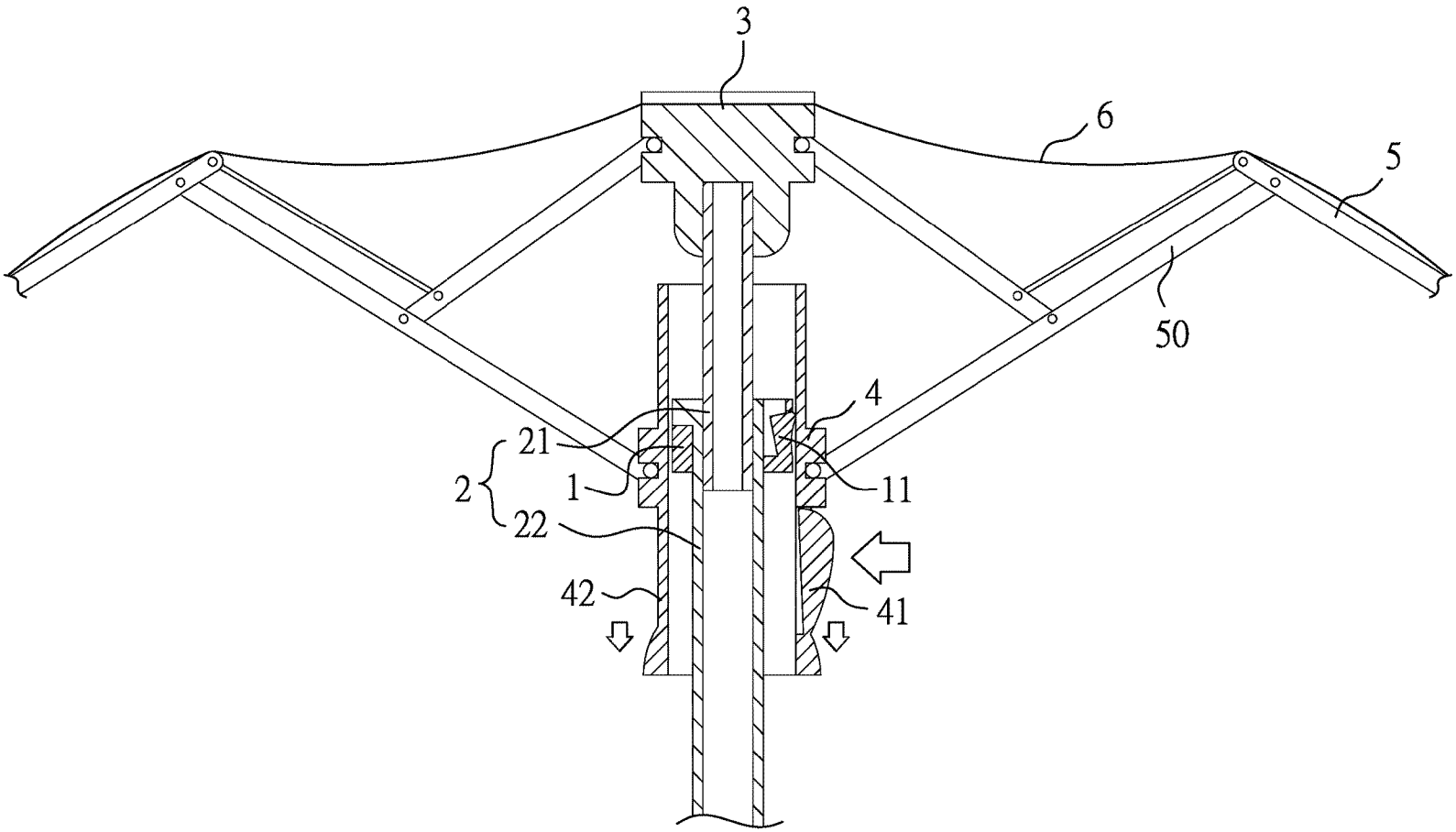
FIG. 3 is a cross sectional view to show the securing device of the present invention when the umbrella is closed.

The runner 4 further includes an extension section 42 which has the release part 41 formed thereto so as to be cooperated with the resilient protrusion 11 of the seat 1. When pressing the release part 41, the resilient protrusion 11 is disengaged from the release part 41. Therefore, when opening the umbrella, the runner 4 is moved to the umbrella-opening position, and the resilient protrusion 11 is engaged with the release part 41 of the runner 4 to position the runner 4 at the opened status. When folding the umbrella, the release part 41 is pressed to retract the resilient protrusion 11, the runner 4 is able to move away from the cap 3 to fold the umbrella as shown in FIG. 3.

In this embodiment, the seat 1 includes a notch 13, and the outer tube 22 includes a boss 221 which is riveted to the outer tube 22 and is engaged with the notch 13 when the outer tube 22 is connected to the seat 1 so that the seat 1 is connected to the outer tube 22.

Figure 4:
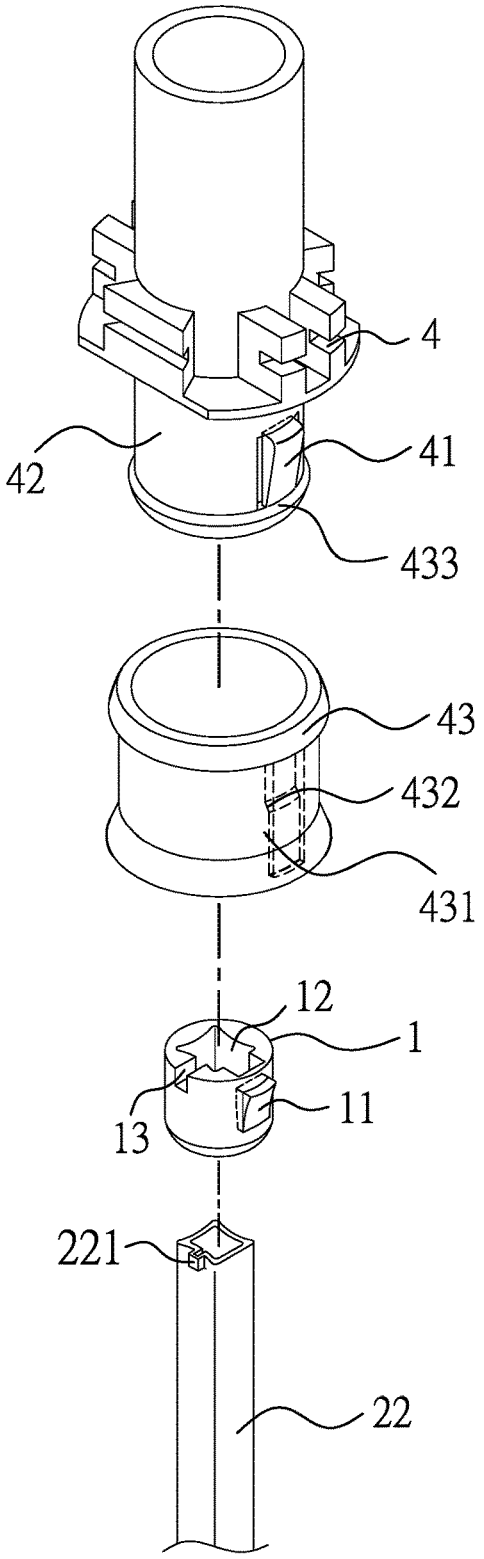
FIG. 4 is an exploded view to show a second embodiment of the securing device of the umbrella of the present invention.
Figure 5:
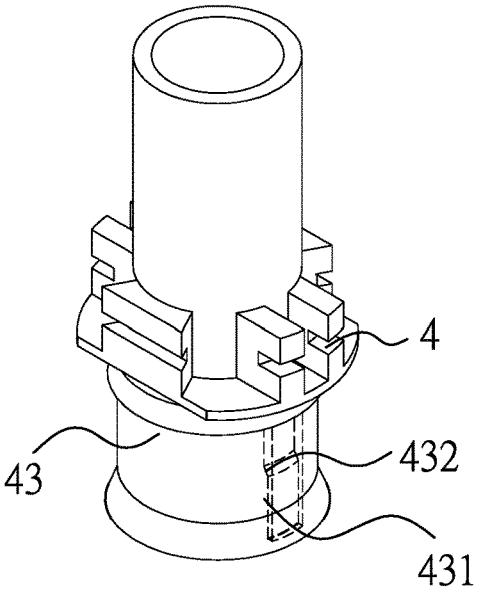
FIG. 5 is a perspective view to show the second embodiment of the securing device of the umbrella of the present invention.
Figure 7:
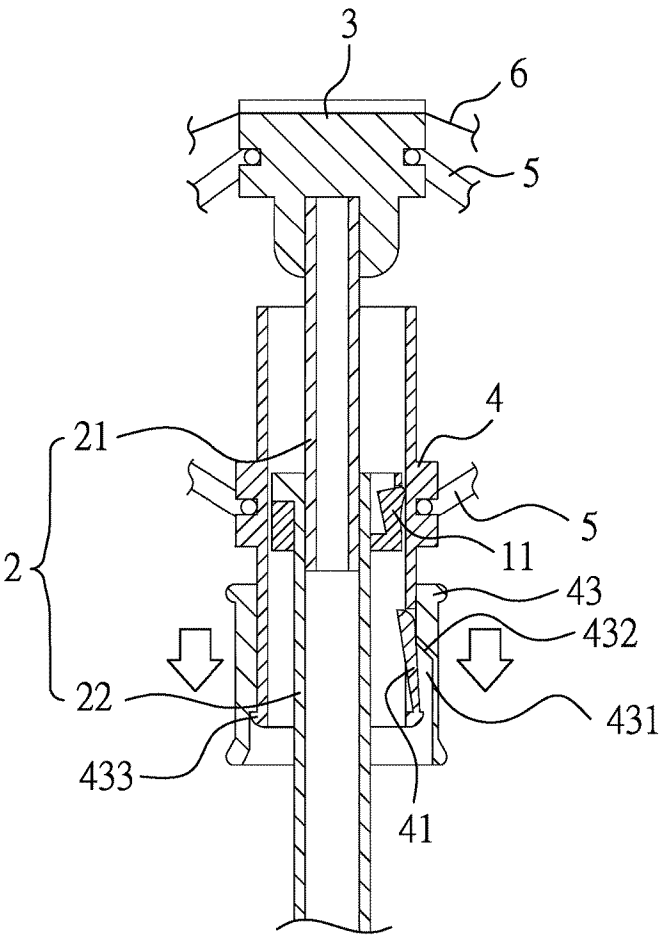
FIG. 7 is a cross sectional view to show the second embodiment of the securing device of the present invention when the umbrella is closed.
Figure 6:
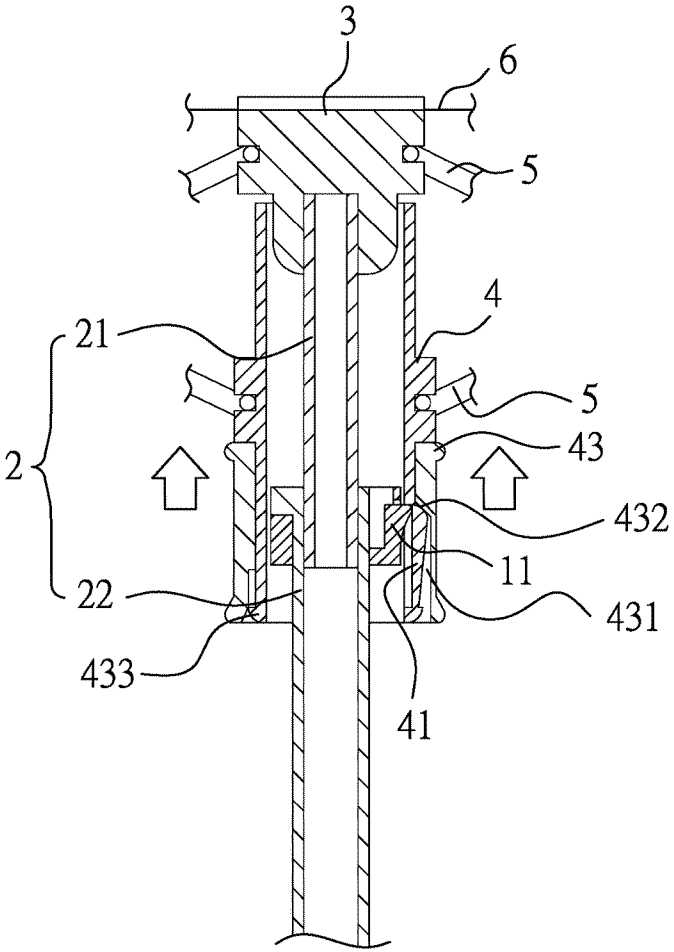
FIG. 6 is a cross sectional view to show the second embodiment of the securing device of the present invention when the umbrella is opened.

As shown in FIGS. 4 and 5, the runner 4 further includes an extension section 42 which has the release part 41 formed thereto. The resilient protrusion 11 is disengaged from the release part 41 when pressing the release part 41. A sleeve 43 is movably mounted to the extension section 42. The sleeve 43 includes a recess 431 defined in the inner periphery thereof, and the sleeve 43 further includes an inclined face 432 formed at the inner top of the recess 431. When opening the umbrella, the runner 4 is moved to the umbrella-opening position s shown in FIG. 6, the resilient protrusion 11 is engaged with the release part 41 of the runner 4, and the release part 41 is accommodated in the recess 431 so that the runner 4 is positioned to stably open the umbrella. When folding the umbrella, the sleeve 43 together with the runner 4 are pulled away from the cap 3, the inclined face 432 pushes the release part 41 inward so that the release part 41 pushes the resilient protrusion 11 which is then released from the engagement with the release part 41. The runner 4 is moved downward as shown in FIG. 7 to fold the umbrella. Furthermore, the sleeve 43 includes a restriction flange 433 at the lower end thereof such that the sleeve 43 is stopped by the restriction flange 433 when the sleeve 43 is pulled downward.

The engagement between the resilient protrusion 11 of the seat 1 and the release part 41 of the runner 4, the gap between the runner 4 and the shaft 2 is eliminated, so that the umbrella is opened stably. The resilient protrusion 11 of the seat 1 improves the shortcoming of unstable runner found gap between the inner periphery of the runner 4 and the shaft 2 of the conventional umbrellas when the umbrellas are opened. Therefore, the inner tubes 21 of the present invention can use larger tubes to reinforce the structural strength of the shaft 2.

While we have shown and described the embodiment in accordance with the present invention, it should be clear to those skilled in the art that further embodiments may be made without departing from the scope of the present invention.

What is claimed is:

1. An umbrella comprising:

a shaft including multiple inner tubes and an outer tube in which the multiple inner tubes are retractably received, one of the inner tubes having the smallest diameter being connected to a cap which is located at a top end of the shaft, a runner movably mounted to the shaft, multiple ribs pivotably connected to the cap, multiple stretchers pivotably connected between the ribs and the runner, a gore mounted to the ribs, and a seat mounted to the outer tube and including a passage through which the outer tube extends, the seat having a resilient protrusion protruding laterally therefrom, the runner including a release part, the resilient protrusion being engaged with the release part when the runner is moved to an umbrella-opening position to open the umbrella.

2. The umbrella as claimed in claim 1, wherein the release part is a pressing plate or a hole.

3. The umbrella as claimed in claim 1, wherein the seat includes a notch, the outer tube includes a boss which is engaged with the notch when the outer tube is connected to the seat.

4. The umbrella as claimed in claim 1, wherein the runner includes an extension section which has the release part formed thereto, the resilient protrusion is disengaged from the release part when pressing the release part.

5. The umbrella as claimed in claim 4, wherein a sleeve is movably mounted to the extension section, the sleeve includes a recess defined in an inner periphery thereof and the release part is accommodated in the recess when opening the umbrella, the sleeve includes an inclined face formed at an inner top of the recess, when moving the runner away from the cap, the inclined face pushes the release part inward.

* * * * *